US009976377B2

(12) United States Patent
Robottom et al.

(10) Patent No.: US 9,976,377 B2
(45) Date of Patent: May 22, 2018

(54) CONTROL LINE TERMINATION ASSEMBLY

(71) Applicant: Cameron International Corporation, Houston, TN (US)

(72) Inventors: Gavin Paul Robottom, Leeds (GB); Adrian Richard Lumb, Keighley (GB)

(73) Assignee: Cameron International Corporation, Houston, TX (US)

( * ) Notice: Subject to any disclaimer, the term of this patent is extended or adjusted under 35 U.S.C. 154(b) by 645 days.

(21) Appl. No.: 14/556,889

(22) Filed: Dec. 1, 2014

(65) Prior Publication Data

US 2016/0153259 A1 Jun. 2, 2016

(51) Int. Cl.
*E21B 33/068* (2006.01)
*E21B 33/038* (2006.01)
*E21B 33/047* (2006.01)

(52) U.S. Cl.
CPC ..... *E21B 33/068* (2013.01); *E21B 33/038* (2013.01); *E21B 33/047* (2013.01)

(58) Field of Classification Search
CPC .... E21B 33/038; E21B 33/047; E21B 33/068; E21B 33/03; E21B 33/0355
See application file for complete search history.

(56) References Cited

U.S. PATENT DOCUMENTS 4,181,175 A 1/1980 McGee et al.
4,770,426 A * 9/1988 Kropatsch ..... E21B 33/047 277/322
6,050,338 A 4/2000 Watkins
6,470,971 B1 * 10/2002 Bridges ..... E21B 33/04 166/379
2010/0206545 A1 8/2010 Nguyen
2011/0011599 A1 * 1/2011 Nguyen ..... E21B 33/068 166/386
2014/0144648 A1 * 5/2014 McKay ..... E21B 33/035 166/367

FOREIGN PATENT DOCUMENTS

CN 201218096 Y 4/2009
GB 2498069 A 7/2013
WO 2009/014797 A1 1/2009

OTHER PUBLICATIONS

PCT International Search Report and Written Opinion; Application No. PCT/US2015/061655; dated Feb. 2, 2016; 11 pages.

* cited by examiner

*Primary Examiner* — Caroline N Butcher
(74) *Attorney, Agent, or Firm* — Fletcher Yoder, P.C.

(57) ABSTRACT

A system includes a control block configured to be coupled to a tree of a wellhead assembly. The control block includes a housing and a plate supported by the housing and having a radially inner wall defining an opening configured to receive a tubing member extending from the tree. The control block also includes a first recess extending circumferentially about the radially inner wall of the plate and configured to support a first annular seal to facilitate sealing the tubing member within the opening while the tubing member is positioned within the opening. The control block may also include a second recess extending circumferentially about the radially-inner wall of the opening and configured to support a second annular seal.

20 Claims, 5 Drawing Sheets

CONTROL LINE TERMINATION ASSEMBLY

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems generally include a wellhead assembly through which the resource is extracted. These wellhead assemblies may include a wide variety of components and/or conduits, such as various control lines, casings, valves, and the like, that control drilling and/or extraction operations.

Control lines and other components of a drilling and production system are typically coupled to one another to provide a path for hydraulic control fluid, chemical injections, or the like to be passed through the wellhead assembly. Such control lines are often disposed in various passages through components of the wellhead assembly, such as a spool tree and/or a tubing hanger. The control lines may be routed to an external location where the control lines are mated with other components, such as a control block that provides hydraulic fluid or the like to the control lines. Unfortunately, typical control blocks include various components, such as seals, that are manually inserted separately from the control block to seal spaces about the control line, rendering coupling typical control blocks to the wellhead assembly difficult and time consuming.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
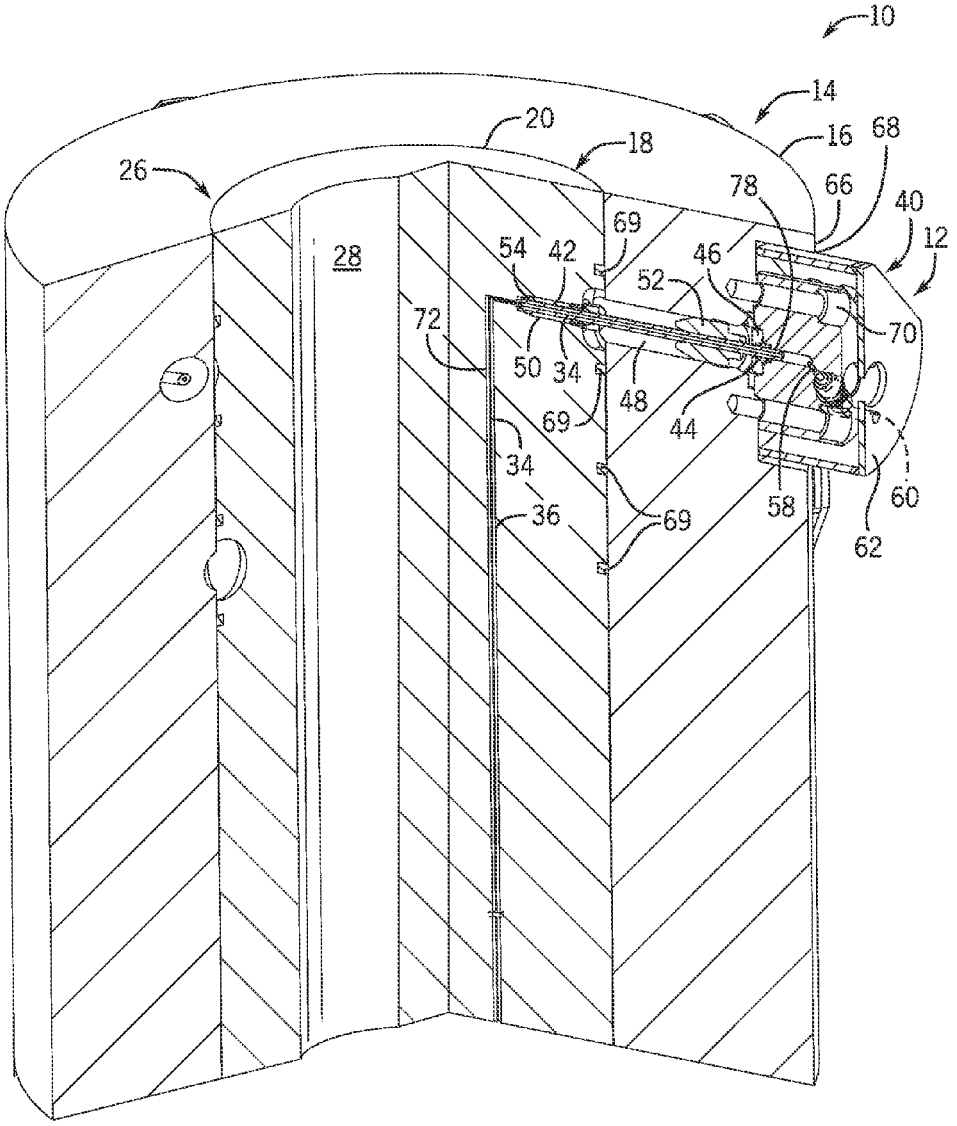
FIG. 1 is a cross-sectional perspective view of a portion of a resource extraction system having a control line termination assembly, in accordance with an embodiment of the present disclosure.
Figure 1:
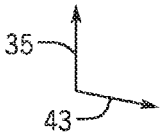

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure include a control line termination assembly having a control block configured to be mounted to a tree (e.g., a spool tree) of a wellhead assembly. The control line termination assembly also includes a tubing member (e.g., a tube) configured to extend generally radially inward from the control block through the spool tree and into a hanger (e.g., a tubing hanger) of the wellhead assembly. The tubing member and the control block are configured to receive and to support a control line, which may be configured to control and/or to gather data from downhole components (e.g., valves, pumps, or the like) within a well or the wellhead.

As discussed below, the control block may be a cartridge-style block having a retention plate (e.g., an annular plate) supporting one or more seals. Thus, the retention plate, the one or more seals, and/or various other components (e.g., control ports, valves, or the like) of the control block may be coupled to and/or removed from the spool tree together as a single unit. For example, during installation of the control line termination assembly, a first end of the tubing member is coupled to a passageway of the tubing hanger, and a second end of the tubing member extends radially outward from the tubing hanger and through the spool tree. The control block is then coupled to the spool tree, such that the second end of the tubing member is received by an opening of the retention plate of the control block, thereby coupling the control block to the tubing member. The one or more seals supported by the retention plate seal the tubing member within the opening. Subsequently, the control line, which may be coupled to one or more control ports and/or valves for controlling hydraulic fluid through the control line, may be routed from the control block, through the tubing member, and into the passageway of the tubing hanger toward the downhole components of the well.

Such a configuration provides for relatively efficient and simple installation of the control line and/or of the control line termination assembly. For example, unlike typical control blocks and related components, the disclosed control line termination assembly may support the control lines such that the control line does not need to be wrapped circumferentially about the tubing hanger. Such a configuration also enables utilization of a large number (e.g., 3, 4, 5, 6, 7, 8, 9, 10, 11, 12, or more) control lines within the tubing hanger. Furthermore, the disclosed control line termination assembly enables installation of the control block and certain seals (e.g., seals supported by the retention plate) as a unit, and thus, does not require separate manual installation of such seals in an offshore or challenging environment. Similarly, the disclosed embodiments may enable efficient removal of the control line and/or of the control line termination assembly as the control line does not need to be unwrapped from the tubing hanger and/or the control block and certain seals may be separated together (e.g., as a single unit) from the spool tree, for example.

With the foregoing in mind, FIG. 1 illustrates a cross-sectional perspective view of a portion of a resource extraction system 10 (e.g., a wellhead system or wellhead assembly) having a control line termination assembly 12, in accordance with an embodiment of the present disclosure. The illustrated system 10 can be configured to extract various minerals, including hydrocarbons (e.g., oil and/or natural gas). Further, the system 10 may be configured to extract minerals and/or inject other substances, such as chemicals used to improve the recovery of the mineral resources. For example, the system 10 may include or be coupled to a mineral extraction system, a mineral transportation system, a mineral processing system, such as a well, wellhead, subsea tree, mineral deposit, controller, a remote location, various tubing, or a combination thereof. In some embodiments, the system 10 may be land-based (e.g., a surface system) or disposed subsea (e.g., a subsea system).

The system 10 includes a valve assembly that is colloquially referred to as a christmas tree 14 (e.g., a tree). As shown, the tree 14 includes a tree body 16 (e.g., a spool body or a housing). In the illustrated embodiment, a hanger 18 (e.g., a tubing hanger) is disposed within the spool body 14 and is colloquially referred to as a "spool tree" assembly 16. The spool tree 16 includes a tubing hanger body 20. Although the present disclosure refers to the tubing hanger 18 and the spool tree 16, it should be understood that the disclosed embodiments may be adapted for use in any of a variety of trees 14, housings, and/or hangers 18. That is, the present application is applicable to vertical trees, in which the tubing hanger is supported in a tubing spool to which the tree is mounted. The spool tree 16 has a spool bore 26 that is configured to receive the tubing hanger 18 and to provide access to a sub-surface well bore, for example. Access to the sub-surface well bore may enable various operations, such as insertion of tubing or casing into the well, the injection of various chemicals into the well, and/or other completion and workover procedures. The illustrated tubing hanger 18 includes a hanger bore 28 that generally aligns with the spool bore 26 and facilitates various operations similar to those described with regard to the spool tree 16. Thus, when the tubing hanger 18 is landed within the spool tree 16, the portions of the spool bore 26 may be sealed with respect to the tubing hanger bore 28. Further, a tubing string may be suspended into the sub-surface well bore via the tubing hanger bore 28, for example.

Assembly of the tubing hanger 18 to the spool tree 16 may include landing the tubing hanger 18 within the spool tree 16. For example, in certain embodiments, the spool tree 16 may be mounted at or above an upper end of a casing string, and the tubing hanger 18 may be landed within the spool tree 16 to suspend a production tubing string within the casing string. The spool tree 16 includes various production and annulus valves to control fluid flow. Thus, landing the tubing hanger 18 within the spool tree 16 may advantageously enable removal of the tubing hanger 18 and any attached production tubing without requiring removal of the spool tree 16. Again, while the disclosed embodiments are described in the context of a spool tree configuration (e.g., the tubing hanger 18 is landed in or installed through the tree 16), it should be understood that the disclosed control line termination assembly 12 and other disclosed features may be adapted for use in other types or configurations of systems 10 with other kinds of trees.

As shown, a portion of the control line 34 is disposed within a passageway 36 (e.g., conduit) that is formed within and extends generally along an axial axis 35 of the tubing hanger body 20. The control line 34 may be configured to control and/or gather data from downhole components, such as pumps, valves, and the like. As discussed in more detail below, a portion of the control line 34 also extends into (e.g., is received by) the control line termination assembly 12, which is configured to couple various devices to the control line 34 to provide hydraulic fluids or regulating pressures to the control line 34, or the like.

As noted above, the control line termination assembly 12 includes a control block 40 configured to be mounted to the spool tree 16. The control line termination assembly 12 also includes a tubing member 42 (e.g., a tube) configured to extend generally radially (e.g., along a radial axis 43) inward from the control block 40 through the spool tree 16 and into the tubing hanger 18. In particular, the tubing member 42 may extend through an opening 44 (e.g., annular opening) in a retention plate 46 (e.g., an annular plate) of the control block 40, through a first space 48 (e.g., annular opening) extending generally radially through the spool tree 16, and through a second space 50 (e.g., annular opening) extending generally radially through at least a portion of the tubing hanger body 20. As discussed in more detail below, the tubing member 42 may be supported within the first space 48 by an alignment guide 52 (e.g., an annular alignment guide).

When installed, a first end 54 of the tubing member 42 is disposed within the tubing hanger 18. In some embodiments, the first end 54 of the tubing member 42 is coupled to the passageway 36, thereby enabling the tubing member 42 to receive the control line 34 that extends into the passageway 36 and toward the downhole components. The first end 54 of the tubing member 42 may be removably coupled to the passageway 36 via any suitable fastener. For example, the first end 54 may be threadably coupled to the tubing hanger 18. In certain embodiments, the first end 54 may have a conical cross-sectional shape (e.g., wedge-fit or compression-fit coupling end 54) to facilitate coupling the first end 54 to the tubing hanger 18. Coupling the first end 54 of the tubing member 42 to the passageway 36 of the tubing hanger 18 seals (e.g., forms a seal between) the passageway 36 to the tubing member 42, thereby isolating the control line 34 from the space (e.g., the first space 48 and/or the second space 50) around the tubing member 42, for example. The tubing member 42 may be a durable and/or a reusable tube. For example, the tubing member 42 may be an autoclave tube configured to withstand high pressures (e.g., pressures greater than 5,000, 10,000, 15,000 psi). In some embodiments, the tubing member 42 may be formed from any suitable material, including metals or metal alloys (e.g., steel or steel alloys).

As noted above, the control block 40 may be a pre-assembled, cartridge-style block having the retention plate 46, one or more seals (shown in FIGS. 2 and 3), and/or various other components, such as a control port 58 and/or a valve 60, disposed within and/or supported by a housing 62. Thus, the retention plate 46, the one or more seals (e.g., annular seals), and/or the various other components (e.g., the control port 58, the valve 60, or the like) of the control block 40 may be pre-assembled and coupled to and/or removed from the spool tree 16 together as a single unit or module. The control block 40 may be coupled to the spool tree 16 via any suitable mount or coupling and at any suitable location. As shown, the control block 40 is coupled to an outer surface 66 of the spool tree 16. In certain embodiments, the control block 40 may be disposed within a corresponding recess 68 (e.g., annular recess, asymmetrical recess, or the like) formed in the outer surface 66 of the spool tree 16. As shown, the control block 40 is removably coupled to the spool tree 16 via removable fasteners 70 (e.g., threaded bolts, screws, or the like).

As discussed in more detail below, in operation, after the tubing hanger 18 is landed within the spool tree 16, the tubing member 42 is inserted radially through the first space 48 of the spool tree 16 and into the second space 50 of the tubing hanger 18. The first end 54 (e.g., threaded annular fitting) of the tubing member 42 is coupled (e.g., threadably coupled) to the passageway 36 that extends along the axial axis 35 of the tubing hanger 18, thereby sealing the tubing member 42 to the passageway 36. In certain embodiments, the alignment guide 52 (e.g., annular guide sleeve) may be inserted into the first space 48 of the spool tree 16 to support and/or to align the tubing member 42. When the tubing member 42 is installed radially within the tubing hanger 18 and the spool tree 16, a second end 78 of the tubing member 42 extends generally radially outward from the first space 48 and/or from the outer surface 66 (e.g., outer circumference or annular surface) of the spool tree 16. The control block 40 is then coupled to the outer surface 66 of the spool tree 16 via the fasteners 70. The control block 40 is positioned such that the second end 78 of the tubing member 42 is received by through the opening 44 of the retention plate 46 and such that the one or more seals (e.g., annular seals) supported by the retention plate 46 seal the tubing member 42 within the opening 44. The control line 34 may be received at the control block 40, where it is coupled to the control port 58 and/or the valve 60 for controlling hydraulic fluid through the control line 34. Thus, the control line 34 extends from the control block 40, through the tubing member 42, and into the passageway 36 of the tubing hanger 18 toward the downhole components of the wellhead.

As noted above, it may be desirable to seal various locations proximate to the control line 34. For example, the tubing hanger 18 may include seals 69 (e.g., annular seals) extending circumferentially about an outer wall (e.g., radially outer wall) of the tubing hanger 18 (e.g., between the tubing hanger 18 and the spool tree 16). These seals 69 may be configured to block pressure migration and/or fluid leaks (e.g., from the control line 34). By way of another example, the tubing hanger 18 generally includes a seal (e.g., annular seal) located at a downhole end of the passageway 36 to seal an annular region 72 between the control line 34 and passageway 36. The seal formed by the first end 54 of the tubing member 42 and the passageway and the seal at the downhole end of the passageway 36 may enable pressurizing the passageway 36 via a test port to verify the integrity of the control line 34, the passageway 36, and the seal formed by the first end 54 of the tubing member 42 and the passageway 36, for example. As discussed in more detail below, the system 10 may also include seals (e.g., annular seals) proximate to the termination of the control line 34 into to the control block 40. Such seals may provide for isolating the pressure of the tubing spool cavity 28 from pressure in the control port 60 and/or ambient pressures external to the system 10, for example.

Figure 2:
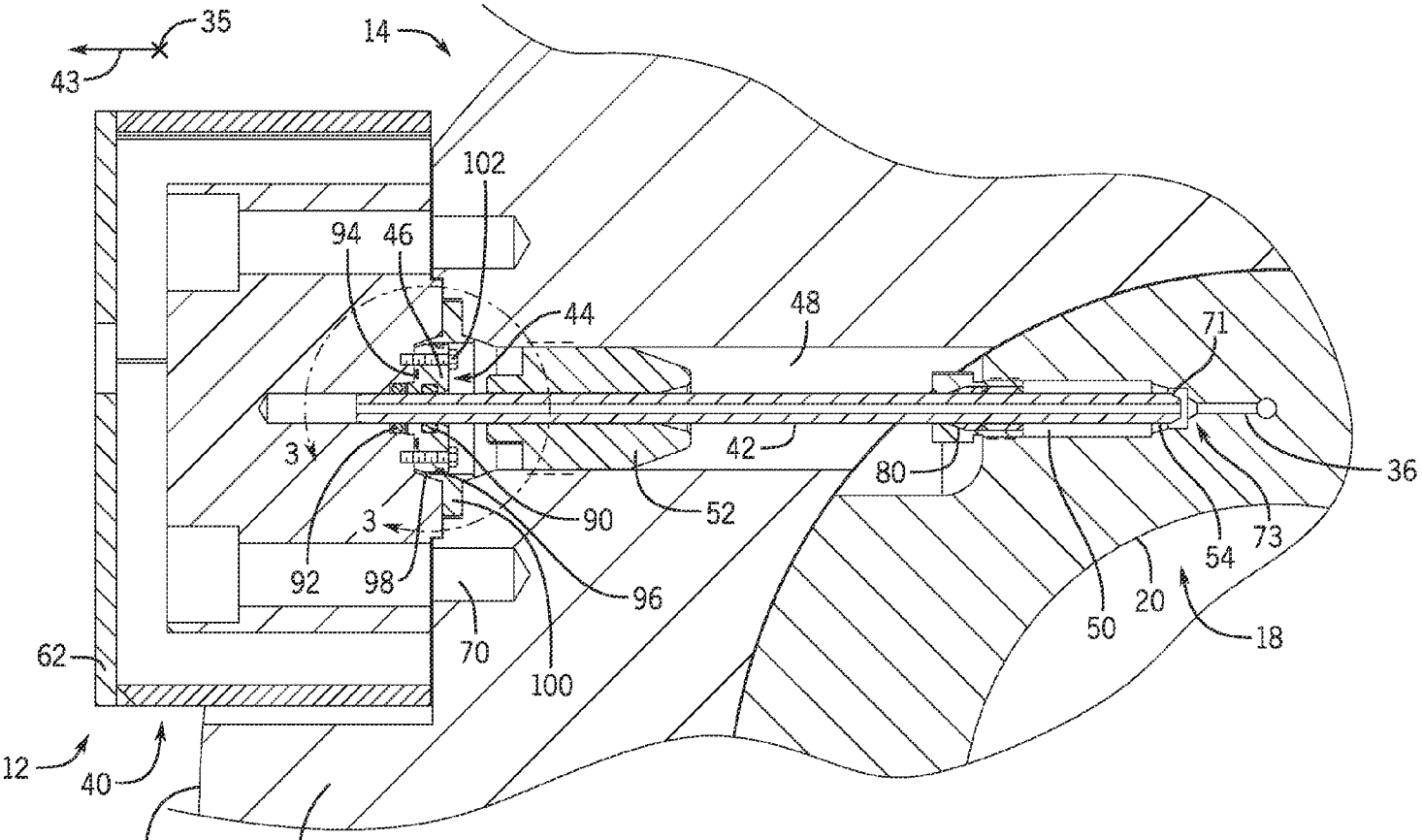
FIG. 2 is a cross-sectional top view of the control line termination assembly of FIG. 1, in accordance with an embodiment of the present disclosure.

FIG. 2 is a cross-sectional top view of the control line termination assembly 12. As shown, the tubing member 42 extends from the control block 40, radially through the first space 48 of the spool tree 16, and radially into the second space 50 of the tubing hanger 18. The first end 54 of the tubing member 42 is coupled to (e.g., sealed to) the passageway 36 of the tubing hanger 18, e.g., via threads 71 of a threaded fitting 73 of the first end 54. The alignment guide 52 (e.g., annular guide sleeve) is disposed within the first space 48 of the spool tree 16 and supports and/or aligns the tubing member 42. In the illustrated embodiment, an annular fitting 80 (e.g., anti-vibration fitting) is disposed within the second space 50 and extends circumferentially about the tubing member 42. In some embodiments, the annular fitting 80 may be coupled (e.g., threadably coupled) to the tubing member 42 prior to insertion of the tubing member 42 into the first space 48 and second space 50. In other embodiments, the annular fitting 80 may be installed about the tubing member 42 after the tubing member 42 is inserted and coupled to the passageway 36.

The control block 40 is secured to the outer surface 66 of the spool tree 16 via the fasteners 70 (e.g., removable threaded fasteners). The tubing member 42 extends radially through the opening 44 of the retention plate 46. As shown, various seals are provided to seal the tubing member 42 within the opening 44 and/or to seal various portions of the control block 40 from the first space 48 of the spool tree 16, for example. In particular, a first annular seal 90 (e.g., elastomer seal) and a second annular seal 92 (e.g., metal seal) may be disposed circumferentially about the opening 44 and may contact the tubing member 42 while the tubing member 42 is positioned within the opening 44. In certain embodiments, a third annular seal 94 (e.g., elastomer seal) may be positioned between the retention plate 46 and the housing 62 of the control block 40. Additionally, in certain embodiments, an annular support ring 96 (e.g., o-ring) may be provided about an outer surface 98 of the retention plate 46. The support ring 96 may facilitate (e.g., guide) installation of a gasket 100 between the spool tree 16 and the control block 40. The retention plate 46 may be coupled to the housing 62 of the control block 40 via any suitable fastener 102 (e.g., threaded bolts, screws, or the like).

Figure 3:
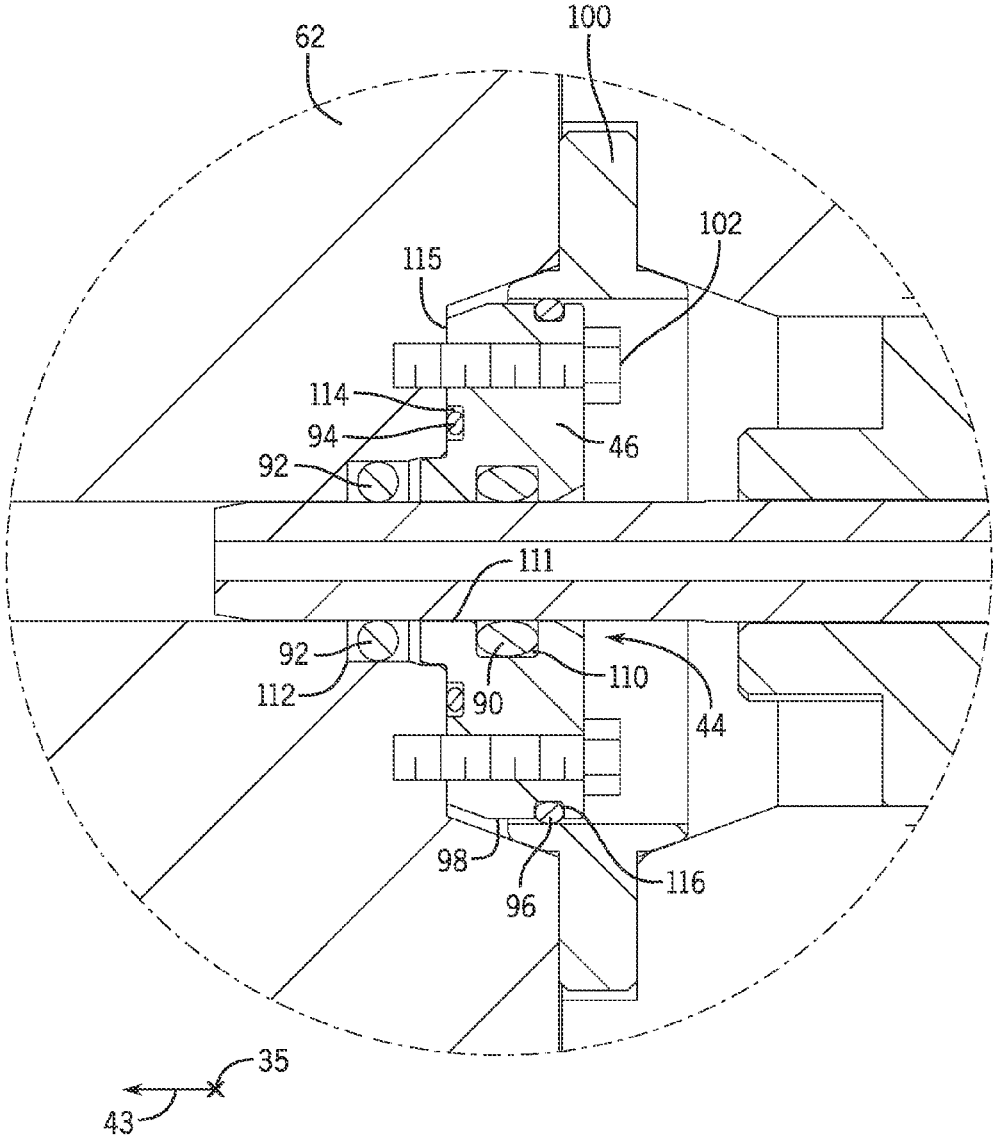
FIG. 3 is a cross-sectional top view of a portion of the control line termination assembly of FIG. 2, taken within line 3-3, in accordance with an embodiment of the present disclosure.

FIG. 3 is a cross-sectional top view of a portion of the control line termination assembly 12, taken within line 3-3 of FIG. 2. As shown, the control block 40 includes the retention plate 46, which may be coupled to the housing 62 or other suitable portion of the control block 40 via fasteners 102. The retention plate 46 is configured to support one or more seals. In the illustrated embodiment, the retention plate 46 includes a first annular recess 110 (e.g., annular groove) formed in a radial inner surface 111 (e.g., annular surface) of the retention plate 46 and configured to support the first annular seal 90. The retention plate 46 also includes a second annular recess 112 (e.g., annular groove) formed in the radial inner surface 111 (e.g., annular surface) of the retention plate 46 or within the housing 62 and configured to support the second annular seal 92. The first annular recess 110 and the second annular recess 112 may each open toward the opening 44, such that the first annular seal 90 and the second annular seal 92 contact the tubing member 42 when the tubing member 42 is inserted within the opening 44. The first annular seal 90 may be formed from any suitable material, including any suitable polymer, elastomer, rubber, fabric, nylon, or the like. Due to its position, the second annular seal 92 may be subjected to high pressure and/or chemicals within the control block 40. Accordingly, in some embodiments, the second annular seal 92 may be formed from any suitable material, such as a metal or metal alloy (e.g., a steel, a carbide, or the like), as noted above. In some embodiments, the second annular seal 92 may be a helical seal (e.g., a helicoil seal or a metal or metal alloy member formed into a helical or spiral shape to form a seal) or a chevron seal (e.g., v-shaped members, such as metal or metal alloy members, adjacent to one another to form a seal), for example.

In certain embodiments, a third annular recess 114 (e.g., annular groove) may be formed in an axially-facing surface 115 of the retention plate 46 and may be configured to support the third annular seal 94. As shown, the third annular seal 94 may be disposed within the third annular recess 114 and supported between the retention plate 46 and the housing 62 of the control block 40. Additionally, in some embodiments, a fourth annular recess 116 (e.g., annular groove) may be formed within the outer surface 98 (e.g., annular surface) of the retention plate 46 and may be configured to support the annular support ring 96. The annular support ring 96 may facilitate installation of the gasket 100, as noted above. As shown, this configuration provides a cartridge-style control block 40 in which the housing 62, the retention plate 46, the various seals (e.g., the first annular seal 90, the second annular seal 92, the third annular seal 96, and/or the annular support ring 96), and/or other components of the control block 40 (e.g., the control port 58 and/or the valve 60) are preassembled (e.g., coupled to one another prior to coupling the control block 40 to the spool tree 16) to facilitate efficient coupling to and/or removal from the spool tree 16 together as a single unit or module (e.g., a self-sealing fluid coupling insert).

Figure 4:
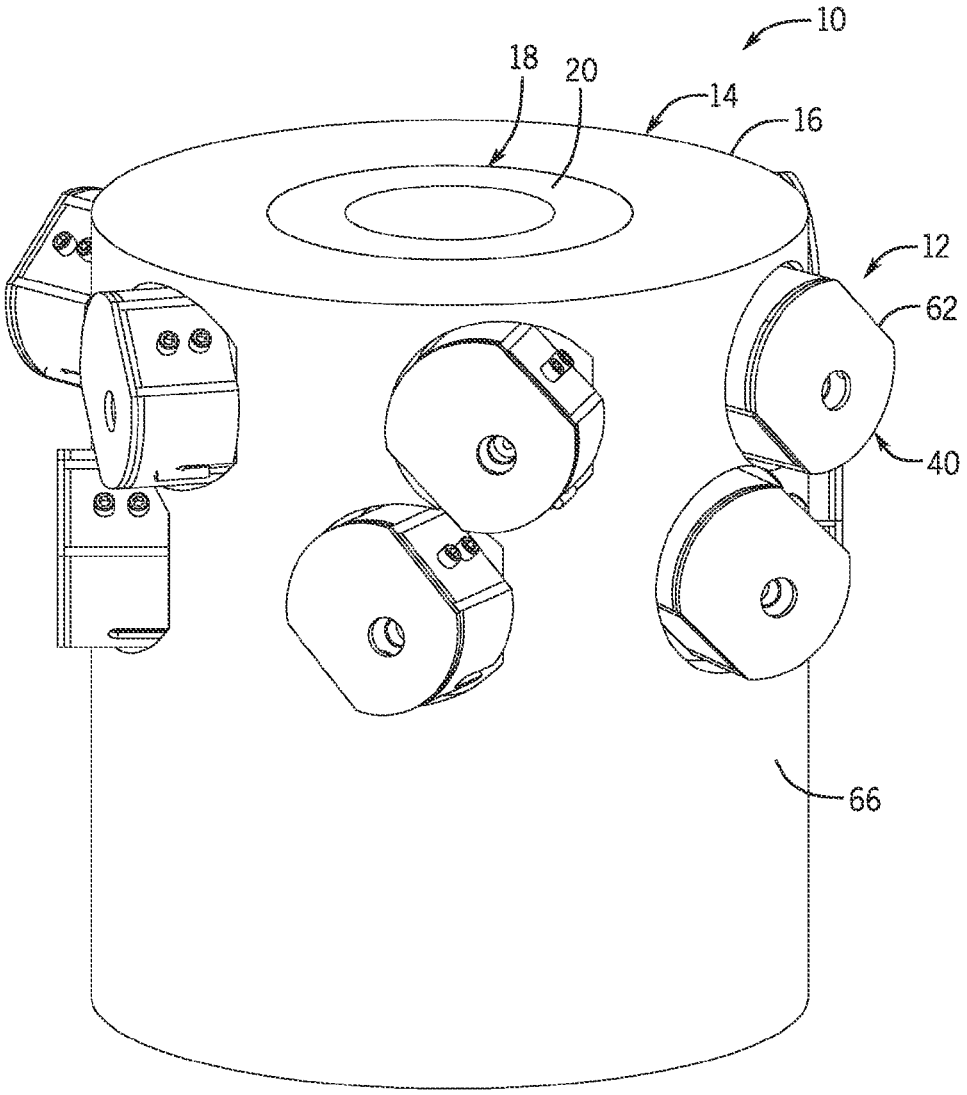
FIG. 4 is a perspective view of a portion of the resource extraction system of FIG. 1, in accordance with an embodiment of the present disclosure.

FIG. 4 is a perspective view of a portion of the resource extraction system 10, in accordance with an embodiment. In certain embodiments, multiple control blocks 40 (e.g., 2, 3, 4, 5, 6, 7, 8, 9, 10, 11, 12, or more) may be provided in a spaced arrangement circumferentially about the outer surface 66 of the spool tree 16. In such cases, each of the multiple control blocks 40 may be configured to receive a corresponding tubing member 42 and to provide hydraulic fluid and/or regulate pressures to a corresponding control line 34, as discussed above with respect to FIGS. 1-3. In some embodiments, some of all of the multiple control blocks 40 may be configured to provide chemicals or fluids to respective control lines 34. Additionally, each of the control blocks 40 includes the various seals and/or other components, such as the control port 58 and/or the valve 60 (shown in FIGS. 1-3). As discussed above, each of the control blocks 40, including the seals and/or other components, maybe efficiently coupled to and/or removed from the spool tree 16, thereby simplifying and expediting termination of the control lines 34.

Figure 5:
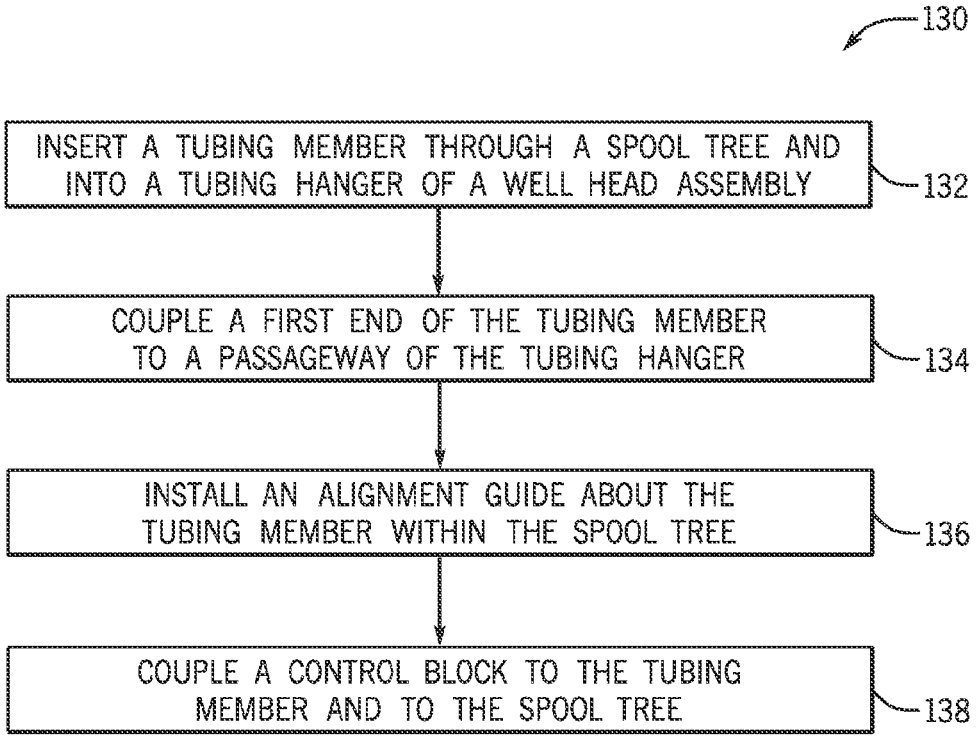
FIG. 5 is a flow diagram of an embodiment of a method for installing a control line termination assembly within a resource extraction system.

FIG. 5 is a flow diagram of a method 130 for installing the control line termination assembly 12 within the system 10. The method includes various steps represented by blocks. Although the flow diagram illustrates the steps in a certain sequence, it should be understood that the steps may be performed in any suitable order, certain steps may be carried out simultaneously, and/or certain steps may be omitted, where appropriate.

In step 132, the tubing member 42 is inserted radially through the first space 48 of the spool tree 16 and into the second space 50 of the tubing hanger body 20. In step 134, the first end 54 of the tubing member 42 is coupled (e.g., threadably coupled) to the passageway 36 that extends along the axial axis 35 of the tubing hanger 18, thereby sealing the tubing member 42 to the passageway 36. In step 136, the alignment guide 52 is inserted into the first space 48 of the spool tree 16 to support and/or to align the tubing member 42.

After installation of the tubing member 42 within the tubing hanger 18 and the spool tree 16, the second end 78 of the tubing member 42 extends generally radially outward from the first space 48 and/or from the outer surface 66 of the spool tree 16. In step 138, the control block 40 is coupled to the outer surface 66 of the spool tree 16 via the fasteners 70. The control block 40 is positioned such that the second end 78 of the tubing member 42 extends through the opening 44 of the retention plate 46 and such that the one or more seals supported by the retention plate 46 seal the tubing member 42 within the opening 44. The control block 40 may be pre-assembled by coupling the retention plate 46 and the one or more annular seals (e.g., the first annular seal 90, the second annular seal 92, the third annular seal 94, and/or the fourth annular seal 96) to one another and/or to the housing 62 prior to coupling the control block 40 to the spool tree 16. The control line 34 may be coupled to the control port 58 and/or the valve 60 for controlling hydraulic fluid through the control line 34. Thus, the control line 34 extends from the control block 40, through the tubing member 42, and into the passageway 36 of the tubing hanger 18 toward the downhole components of the wellhead. The disclosed method enables efficient and simple installation of and/or removal of the control line 34 and/or the control line termination assembly 12. For example, the disclosed method enables installation of and/or removal of the control line termination assembly 12 without installation of manual seals proximate to the termination of the control line 34 at the control block 40. The disclosed method also enables installation of and/or removal of the control line termination assembly 12 without wrapping the control lines 34 circumferentially about the tubing hanger 18, thereby facilitating use of multiple control lines 34 and multiple control line termination assemblies 12 within the system 10.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a tubing member; and a control block configured to be coupled to a tree of a wellhead assembly, the control block comprising:

a housing;

a plate supported by the housing and having a radially inner wall defining an opening configured to receive the tubing member extending from the tree; and a first recess extending circumferentially about the radially inner wall of the plate and configured to support a first annular seal to facilitate sealing of the tubing member within the opening while the tubing member is positioned within the opening;

wherein the tubing member is configured be inserted into the tree, such that the tubing member extends through the tree and into a hanger of the wellhead assembly and couples to a passageway extending generally longitudinally through the hanger, and wherein the tubing member and the control block are configured to receive and to support a control line that extends through the tubing member and through the passageway to one or more downhole components of the wellhead assembly.

2. The system of claim 1, wherein the first annular seal is a helical seal or a chevron seal.

3. The system of claim 1, wherein the first annular seal is formed from an elastomer, a metal, or a metal alloy material.

4. The system of claim 1, wherein the control block comprises a control port configured to be coupled to and to deliver a hydraulic fluid to the control line that extends through a channel of the tubing member and the passageway to the one or more downhole components.

5. The system of claim 1, wherein the tubing member extends from a first end that is configured to couple to the passageway to a second end, the control block comprises a second recess extending circumferentially about the radially-inner wall of the plate, the first recess supports the first annular seal and the second recess supports a second annular seal that facilitates sealing of the tubing member within the opening, the first annular seal comprises an elastomer material and the second annular seal comprises a metal or metal alloy material, the first recess supporting the first annular seal is positioned within the opening such that the first annular seal is proximate to the first end of the tubing member when the tubing member is positioned within the opening and when the control block is coupled to the tree of the wellhead assembly, and the second recess supporting the second annular seal is positioned within the opening such that the second annular seal is between the first recess and the second end of the tubing member along a radial axis of the tree when the tubing member is positioned within the opening and when the control block is coupled to the tree of the wellhead assembly.

6. The system of claim 1, comprising multiple other tubing members and multiple other control blocks, wherein each of the multiple other control blocks comprises a respective housing, a respective plate, and a respective first recess configured to support a respective first annular seal to facilitate sealing of a respective one of the multiple other tubing members, wherein the control block and the multiple other control blocks are coupled to the tree of the wellhead assembly at discrete locations about a circumference of the tree to facilitate passage of multiple control lines to multiple downhole components.

7. The system of claim 1, wherein the plate is coupled to the housing via one or more first fasteners and the control block is configured to be coupled to the tree of the wellhead assembly via one or more second fasteners.

8. The system of claim 1, comprising an annular support ring extending circumferentially about a radially-outer surface of the plate.

9. The system of claim 1, wherein the tubing member comprises a one-piece annular structure that extends from a first end to a second end, and the first end is configured to couple to the passageway and the second end is configured to be positioned within the control block.

10. A system, comprising:

a tubing member configured to be inserted through a tree and into a hanger of a wellhead assembly, wherein a first end of the tubing member comprises a threaded end that is configured to be threadably coupled to a passageway extending generally longitudinally within the hanger and a second end of the tubing member is configured to extend generally radially outward from the tree while the first end of the tubing member is threadably coupled to the passageway; and a control block having a plate supporting a first annular seal, wherein the control block is configured to receive the tubing member within an annulus of the first annular seal when the control block is coupled to the tree of the wellhead assembly.

11. The system of claim 10, comprising a second annular seal supported by the plate, wherein the first annular seal comprises an elastomer material and the second annular seal comprises a metal or metal alloy material.

12. The system of claim 10, wherein the tubing member and the control block are configured to receive and to support a control line coupled to one or more downhole components of the wellhead assembly, wherein the control line extends through a channel of the tubing member and through the passageway to the one or more downhole components of the wellhead assembly.

13. The system of claim 10, wherein the tubing member comprises a continuous annular structure that extends from the first end to the second end.

14. A method, comprising:

positioning a tubing member that extends from a first end to a second end proximate to a tree of a wellhead assembly;

inserting the first end of the tubing member through a first space extending generally radially through the tree of the wellhead assembly and into a second space extending generally radially within a hanger of the wellhead assembly;

subsequently receiving the second end of the tubing member that extends radially outwardly from the wellhead assembly within an annular opening of a control block; and coupling the control block to the tree, wherein the control block comprises one or more annular seals disposed about an opening that is configured to receive the tubing member when the control block is coupled to the tree.

15. The method of claim 14, comprising inserting an alignment guide about the tubing member within the tree after inserting the first end of the tubing member through the first space.

16. The method of claim 14, comprising coupling the first end of the tubing member to a passageway of the hanger, wherein the passageway is configured to extend generally longitudinally along the hanger to facilitate routing a control line from a channel of the tubing member to downhole components of the wellhead assembly.

17. The method of claim 14, wherein the one or more annular seals comprise a first seal comprising an elastomer material and a second seal comprising a metal material.

18. The method of claim 14, comprising pre-assembling the control block, wherein a plate defining the opening and the one or more annular seals disposed about the opening are coupled to one another and to a housing of the control block prior to coupling the control block to the tree.

19. The method of claim 14, comprising threadably coupling the first end of the tubing member to a passageway of the hanger via threads of a threaded fitting of the first end.

20. The method of claim 14, comprising:

coupling a control line to a valve supported by the control block;

extending the control line from the valve, through a channel of the tubing member, and through a longitudinally-extending passageway of the tree to downhole components of the wellhead assembly; and adjusting the valve to provide a fluid through the control line.

* * * * *